US006139074A

United States Patent [19]

Barnett et al.

[11] Patent Number: 6,139,074

[45] Date of Patent: Oct. 31, 2000

[54] WINDOW LOCKING SYSTEM

[75] Inventors: Ralph L. Barnett, Wilmette; William Anthony Wangler, Elmhurst, both of Ill.

[73] Assignee: Triodyne Wangler Construction Specialties, LLC, Niles, Ill.

[21] Appl. No.: 09/312,175

[22] Filed: May 14, 1999

[51] Int. Cl.[7] ..... E05C 3/02

[52] U.S. Cl. ..... 292/240; 292/DIG. 20; 292/DIG. 47; 292/108

[58] Field of Search ..... 292/240, 108, 292/241, 242, DIG. 54, DIG. 20, 104, 106, 107, 98, 101, 285, DIG. 47

[56] References Cited

U.S. PATENT DOCUMENTS

| | | | |
|---|---|---|---|
| 587,424 | 8/1897 | Bonine | 292/240 |
| 890,873 | 6/1908 | Robinson | 292/108 |
| 1,153,514 | 9/1915 | North et al. | 292/241 |
| 1,941,432 | 12/1933 | Doering | 292/241 |
| 2,613,524 | 10/1952 | Holmsten | 292/241 |
| 2,653,044 | 9/1953 | Vickers | 292/108 |
| 2,754,142 | 7/1956 | Baker, Jr. | 292/6 |
| 3,514,142 | 5/1970 | Smith | 292/108 |
| 3,642,314 | 2/1972 | Smith et al. | 292/134 |
| 4,014,572 | 3/1977 | Binns | 292/108 |
| 4,932,694 | 6/1990 | Cater, Sr. | 292/210 |

*Primary Examiner*—Lynne H. Browne
*Assistant Examiner*—John B. Walsh
*Attorney, Agent, or Firm*—Pauley Petersen Kinne & Fejer

[57] ABSTRACT

A window locking system which prevents unintended opening of a window. The window locking system includes a base element which is attachable to a window and which forms a slot. Disposed within the slot is a latching member pivotally connected to the base element. The latching member includes a handle element and an oppositely disposed latching finger extending from opposite faces of the base element. A locking key which is rotatable between a locking position and an unlocking position is connected to the base element. The locking key prevents the latching member from pivoting from a closed position to an open position when oriented in its locking position.

9 Claims, 3 Drawing Sheets

WINDOW LOCKING SYSTEM

BACKGROUND OF THE INVENTION

1. Field of the Invention

This invention relates to window latches and, in particular, a window latch locking means which prevents the window latch from either opening under certain conditions on its own or from being opened by unauthorized individuals such as intruders and small children. Thus, in addition to preventing damage to the interior space of a building from weather related incidents due to untended opening of the window latch, the window locking system of this invention also acts as a safety device for the protection, in particular, of small children.

2. Description of Prior Art

There is a substantial variety of window latching systems available in the marketplace today. One such system typically employed on windows opening, for example by tilting, into the interior space of a room comprises a base element attachable to the window and forming an opening in which a latching member typically connected to the base element is disposed. The latching member comprises a latching finger which, in the latching position extends into the window frame in which it engages a complementary latching element such as a pin which is supposed to maintain the latching member in a closed position. We have found, however, that window latching systems of this type are readily blown open during periods when the windows are subjected to heavy and sustained buffeting winds, such as frequently occurs with high rise buildings. Specifically, continuous pounding by the wind causes such window latches, typically located over the center of the window, to unlatch the windows. Accordingly, there is a need for some means to prevent such window latching systems from becoming unlatched under conditions such as these.

SUMMARY OF THE INVENTION

Accordingly, it is one object of this invention to provide a window latching system which cannot become unintentionally unlatched by exposure to heavy and sustained buffeting winds.

It is another object of this invention to provide a window latching system which prevents children from unlatching the window latching system.

It is a further object of this invention to provide a device which is attachable to existing window latching systems which prevents the latching system from becoming unintentionally unlatched.

It is yet a further object of this invention to provide a device for preventing a window latching system from becoming unintentionally unlatched which is retrofittable to an existing window latching system without a requirement for drilling or otherwise physically altering the window, which could void a window warranty.

These and other objects of this invention are addressed by a window locking system comprising a base element attachable to a window and forming a slot, a latching member comprising a handle element and a latching finger disposed within the slot and pivotally connected to the base element, which handle element and latching finger extend from opposite faces of the base element with the latching finger disposed on a window facing side of the base element, and a locking key connected to one of the base element and the window rotatable between a locking position and an unlocking position, which locking key prevents the latching member from pivoting from a latched position to an unlatched position when oriented in the locking position. In accordance with one preferred embodiment, the base element comprises two opposing boss elements disposed on opposite sides of the slot and extending substantially perpendicular to a plane of the window and the latching member is pivotally connected to the boss elements. In accordance with a particularly preferred embodiment, the locking key comprises a base portion and a tab portion. The tab portion is elevated with respect to the base portion and extends over a latching member tab extending from the latching member when the locking key is oriented in the locking position. In accordance with another preferred embodiment, the tab portion of the locking key, which is elevated with respect to the base portion of the locking key, extends beneath a latching member tab extending from the latching member when the locking key is oriented in the locking position.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1B:
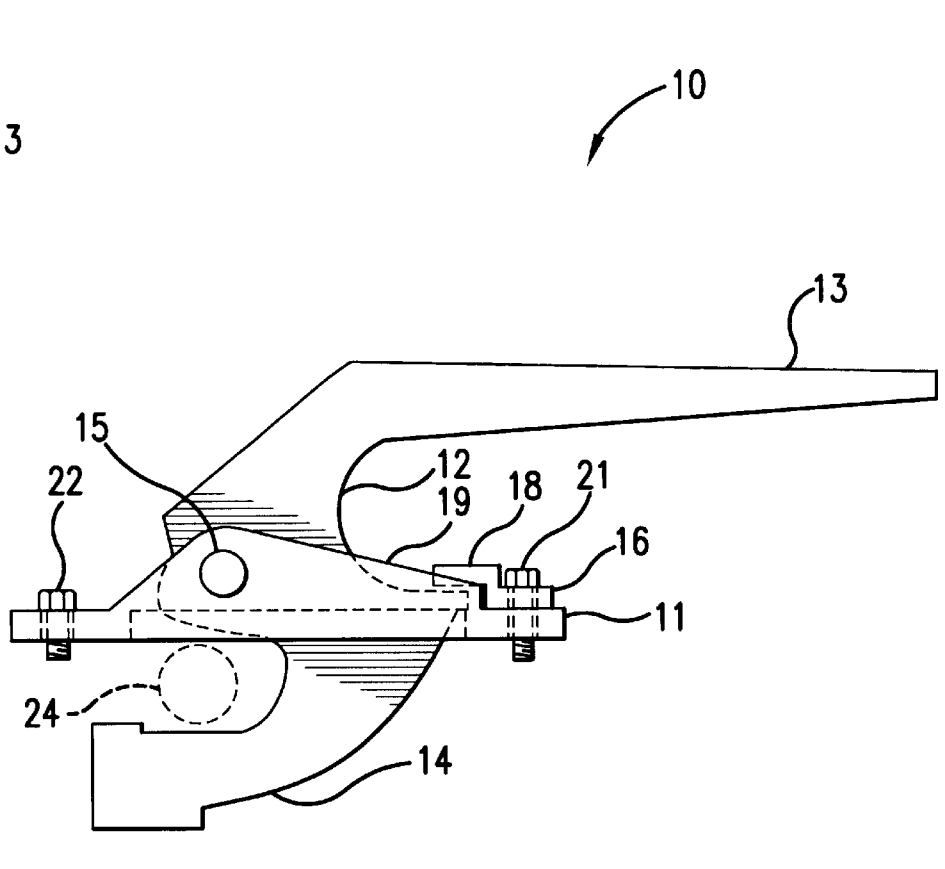
FIG. 1B is a lateral view of the window locking system shown in FIG. 1A in a closed position.
Figure 1A:
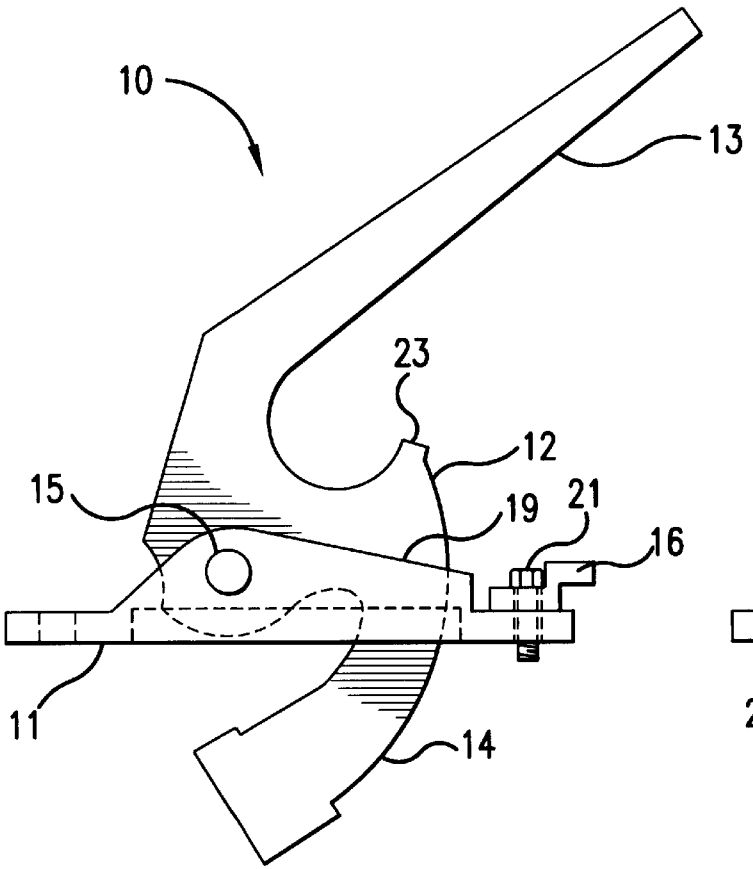
FIG. 1A is a lateral view of a window locking system in accordance with one embodiment of this invention in an open position.
Figure 2:
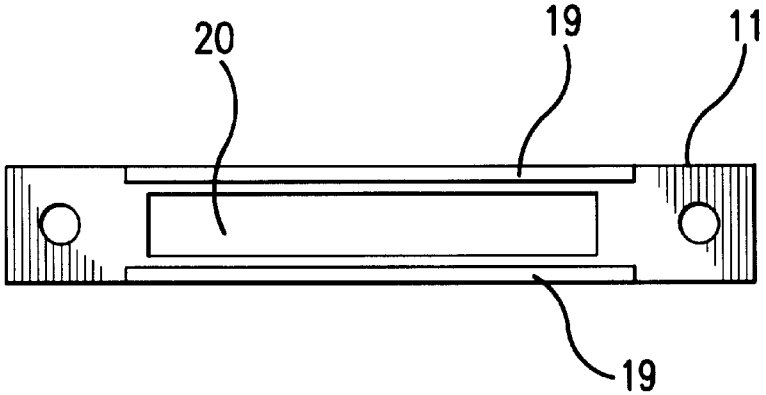
FIG. 2 is a plan view of a base element for a window locking system in accordance with this invention.

FIGS. 1A and 1B show a window locking system in accordance with one preferred embodiment of this invention in open and locked positions, respectively. As shown, window locking system 10 comprises a base element 11 which is attachable by fasteners 21, 22 to a window (not shown). Base element 11, as shown in FIG. 2, forms slot 20 and comprises opposing boss elements 19 connected to base element 11 on opposite sides of slot 20 and extending from base element 11 substantially perpendicular to a plane of the window. Disposed within and extending through slot 20 is a latching member 12 which comprises handle element 13 and latching finger 14 extending from opposite faces of base element 11 with latching finger 14 disposed on a window facing side of base element 11. Latching member 12 is pivotally connected at pivot point 15 to boss elements 19. When latching member 12 is in a closed position as shown in FIG. 1B, latching finger 14 engages a complementary latching member 24, for example, a post or pin embedded within the window frame against which the window is locked, shown for illustrative purposes only in FIG. 1B.

To prevent latching member 12 from opening unintentionally by itself or from being opened by a child, window locking system 10 comprises locking key 16 connected to base element 11. It will, however, be apparent to those skilled in the art that locking key 16 may be connected to the window itself, and such embodiment, although not preferred, is deemed to be within the scope of the invention claimed herein. Locking key 16 is rotatable between an unlocking position as shown in FIG. 1A and a locking position as shown in FIG. 1B.

Figure 3:
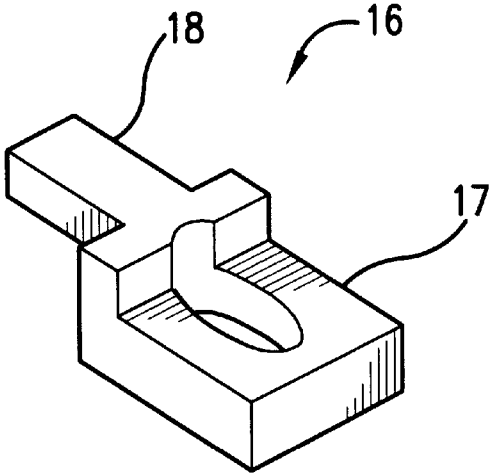
FIG. 3 is a perspective view of a locking key for a window locking system in accordance with one embodiment of this invention.

Locking key 16 as shown in FIG. 3 comprises a locking key base 17 and a locking key tab 18 connected to locking key base 17 and elevated with respect thereto. When locking key 16 is disposed in a locking position, as shown in FIG. 1B, locking key tab 18 extends over latching member tab 23 which extends from latching member 10. It will readily be seen that when disposed in the locking position, locking key tab 18 precludes latching member 12 from being pivoted around pivot point 15. As shown in FIG. 1B, a slightly longer fastener 21 than that used to secure base element 11 to a window to accommodate the extra thickness of the locking key base 17 is used to connect locking key 16 to base element 11. In order to rotate locking key 16 between an unlocked position as shown in FIG. 1A and a locking position as shown in FIG. 1B, fastener 21 is merely loosened.

To provide additional "child proofing", fastener 21 is a tamper resistant fastener requiring a "special tool" for tightening locking key 16 into its locking position. In accordance with one preferred embodiment, fastener 21 includes an "allen head". Due to physical limitation of distance between handle element 13 and fastener 21, a conventional allen wrench will not fit beneath handle element 13 when locking key 16 is being tightened into its locked position. Consequently, the length of a short leg of a regular allen wrench must be reduced to function with the proposed invention, thereby providing a "special tool" feature which enhances the tamper resistance of the window latching system of this invention.

In accordance with one particularly preferred embodiment of this invention, in the locking position of locking key 16, locking key tab 18 is positioned between the two boss elements 19, thereby precluding any locking key tab rotation that might allow locking key 16 to move out of the locking position. And, as previously stated, when locking key 16 is in a locking position, with locking key base 17 snugly abutting base element 11, no rotation of latching member 12 around pivot point 15 can occur due to the associated interference caused by locking key tab 18 with respect to latching member tab 23.

Figure 5:
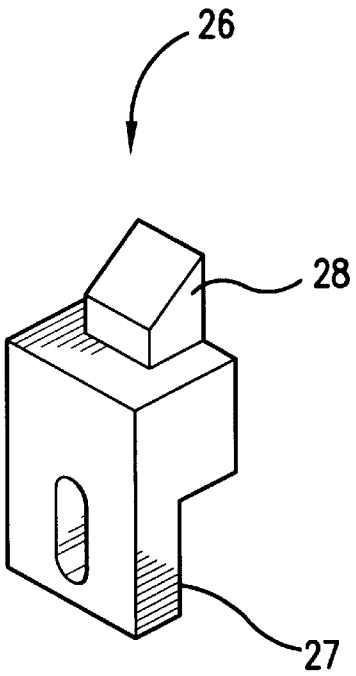
FIG. 5 is a perspective view of a locking key for a window locking system in accordance with one embodiment of this invention.
Figure 4:
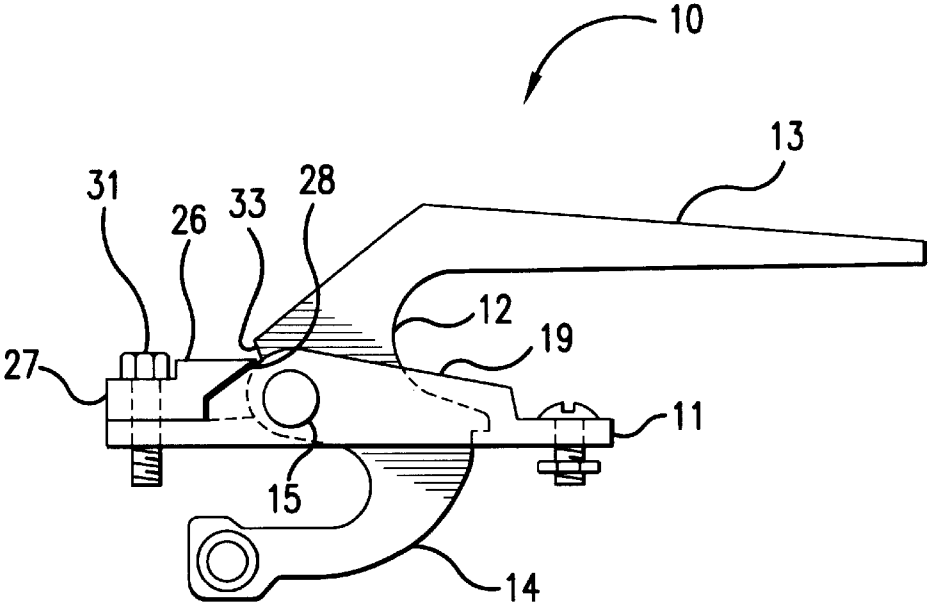
FIG. 4 is a lateral view of a window locking system in accordance with one embodiment of this invention.

FIG. 4 is a lateral view of a window locking system in accordance with another embodiment of this invention. In accordance with this embodiment, locking key 26 is disposed at the opposite end of base element 11 from the embodiment shown in FIGS. 1A and 1B. Locking key 26 is secured to base element 11 and the window (not shown) by fastener 31. Locking key 26, as shown in FIG. 5, comprises locking key base 27 and locking key tab 28. As shown in FIG. 4, locking key tab 28 extends beneath latching member tab 33 disposed on the side opposite latching member tab 23 of latching member 12. In this way, when locking key 26 is disposed in a locking position, thereby engaging latching member tab 33, locking key tab 28 prevents the rotation of latching member 12 around pivot point 15, thereby preventing unintentional opening of latching member 12.

In order to provide resistance to unauthorized unlatching of the window, it is a requirement of the window latching system of this invention that locking key 16 be constructed of a material having the structural integrity to resist fracture of the locking key tab during such unauthorized attempts. In accordance with a particularly preferred embodiment of this invention, locking key 16 is constructed of stainless steel.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A window locking system comprising:

a base element attachable to a window and forming a slot;

a latching member comprising a handle element and a latching finger disposed within said slot and pivotally connected to said base element, said handle element and said latching finger extending from opposite faces of said base element with said latching finger disposed on a window facing side of said base element; and a locking key connected to one of said base element and said window rotatable between a locking position and an unlocking position, said locking key comprising a base portion and a tab portion, said tab portion at least partially elevated with respect to a top surface of said base portion and extending one of over and beneath a latching member tab extending from said latching member when said locking key is oriented in said locking position, and preventing said latching member from pivoting from a closed position to an open position when oriented in said locking position.

2. A window locking system in accordance with claim 1, wherein said base element comprises two opposing boss elements disposed on opposite sides of said slot and extending substantially perpendicular to a plane of said window and said latching member is pivotally connected to said boss elements.

3. A window locking system in accordance with claim 2, wherein said tab portion is disposed between said two opposing boss elements when said locking key is oriented in said locking position.

4. A window locking system in accordance with claim 1, wherein said locking key is made of stainless steel.

5. A window locking system in accordance with claim 1, wherein said locking key is connected to said base element by a fastener attaching said base element to said window.

6. In a window locking system comprising a base element attachable to a window and forming a slot, a latching member comprising a handle element and a latching finger disposed with said slot and pivotally connected to said base element, and said handle element and said latching finger extending from opposite faces of said base element with said latching finger disposed on a window facing side of said base element, the improvement comprising:

a locking key comprising a base portion and a tab portion connected to said base element and rotatable between a locking position and an unlocking position, said tab position elevated with respect to a top surface of said base portion and extending one of over and beneath a latching member tab extending from said latching member when said locking key is oriented in said locking position whereby said locking key prevents said latching member from pivoting from a closed position to an open position when oriented in said locking position.

7. A window locking system in accordance with claim 6, wherein two opposing boss elements are connected to said base element on opposite sides of said slot and extend from said base element substantially perpendicular to a plane of said window, and said tab portion is disposed between said boss elements when said locking key is oriented in said locking position.

8. A window locking system in accordance with claim 6, wherein said locking key is connected to said base element by a fastener attaching said base element to said window.

9. A window locking system in accordance with claim 6, wherein said locking key is constructed of stainless steel.

* * * * *